US006329052B1

(12) United States Patent
Groh et al.

(10) Patent No.: US 6,329,052 B1
(45) Date of Patent: Dec. 11, 2001

(54) BLOWABLE INSULATION

(75) Inventors: Zivile M Groh, Sommerville; Victor P. Laskorski, N. Attleborough, both of MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/332,219

(22) Filed: Jun. 14, 1999

Related U.S. Application Data

(63) Continuation-in-part of application No. 09/300,028, filed on Apr. 27, 1999.

(51) Int. Cl.[7] ..... D04H 1/00; D21B 1/04

(52) U.S. Cl. ..... 428/360; 442/416; 442/327; 428/361; 428/375; 428/378

(58) Field of Search ..... 442/327, 416, 442/340, 344, 351; 428/360, 361, 375, 378

(56) References Cited

U.S. PATENT DOCUMENTS

| | | | | |
|---|---|---|---|---|
| Re. 27,587 | | 2/1973 | Paliyenko et al. . | |
| 1,714,240 | | 5/1929 | Rayner . | |
| 2,314,482 | | 3/1943 | De Fries . | |
| 2,339,431 | | 1/1944 | Slayter . | |
| 2,713,547 | | 7/1955 | Frederick . | |
| 2,926,980 | * | 2/1960 | Steinruck . | |
| 2,958,919 | | 11/1960 | Palmer . | |
| 3,046,173 | | 7/1962 | Copeland . | |
| 3,373,455 | | 3/1968 | Kaplan . | |
| 3,423,795 | | 1/1969 | Watson . | |
| 3,461,026 | | 8/1969 | Schick . | |
| 3,511,747 | * | 5/1970 | Davies . | |
| 3,589,956 | * | 6/1971 | Krantz et al. . | |
| 3,654,055 | | 4/1972 | Gray . | |
| 3,702,260 | * | 11/1972 | Jayne et al. . | |
| 3,733,245 | | 5/1973 | Veazey et al. . | |
| 3,772,137 | | 11/1973 | Tolliver . | |
| 3,828,934 | | 8/1974 | Green et al. . | |
| 3,892,909 | * | 7/1975 | Miller . | |
| 3,923,942 | * | 12/1975 | Nishiumi et al. . | |
| 4,040,371 | | 8/1977 | Cooper et al. . | |
| 4,065,599 | * | 12/1977 | Nishiumi et al. . | |
| 4,118,531 | | 10/1978 | Hauser . | |
| 4,129,675 | | 12/1978 | Scott . | |
| 4,144,294 | * | 3/1979 | Werthaiser et al. . | |
| 4,164,534 | * | 8/1979 | Orgino . | |
| 4,167,604 | | 9/1979 | Aldrich . | |
| 4,248,927 | | 2/1981 | Liebman . | |
| 4,259,400 | | 3/1981 | Bolliand . | |
| 4,293,604 | | 10/1981 | Campbell . | |
| 4,304,817 | | 12/1981 | Frankosky . | |
| 4,364,996 | | 12/1982 | Sugiyama . | |
| 4,400,426 | * | 8/1983 | Aldrich | 428/290 |
| 4,401,610 | | 8/1983 | Ohberg . | |
| 4,413,030 | * | 11/1983 | Tesch et al. . | |
| 4,418,103 | | 11/1983 | Tani et al. . | |
| 4,468,336 | | 8/1984 | Smith . | |
| 4,477,515 | * | 10/1984 | Masuda et al. . | |
| 4,481,256 | * | 11/1984 | Masuda et al. . | |
| 4,540,625 | * | 9/1985 | Sherwood . | |
| 4,551,378 | | 11/1985 | Carey, Jr. . | |
| 4,555,421 | | 11/1985 | Yasue . | |
| 4,588,635 | | 5/1986 | Donovan . | |
| 4,618,531 | * | 10/1986 | Marcus . | |
| 4,681,789 | | 7/1987 | Donovan et al. . | |
| 4,783,364 | * | 11/1988 | Ilan . | |
| 4,794,038 | * | 12/1988 | Marcus . | |
| 4,814,229 | * | 3/1989 | Tesch . | |
| 4,818,599 | * | 4/1989 | Marcus . | |
| 4,820,574 | * | 4/1989 | Tesch . | |
| 4,886,693 | | 12/1989 | Haranoya et al. . | |
| 4,911,980 | * | 3/1990 | Tesch . | |
| 4,917,943 | * | 4/1990 | Tesch . | |
| 4,921,645 | * | 5/1990 | Insley | 264/6 |
| 4,940,502 | * | 7/1990 | Marcus . | |
| 4,992,327 | | 2/1991 | Donovan et al. . | |
| 4,998,309 | * | 3/1991 | Tesch . | |
| 5,043,207 | | 8/1991 | Donovan et al. . | |
| 5,057,168 | | 10/1991 | Muncrief . | |
| 5,064,689 | | 11/1991 | Young, Sr. et al. . | |
| 5,080,964 | * | 1/1992 | Tesch . | |
| 5,082,711 | | 1/1992 | Goerens . | |
| 5,112,684 | * | 5/1992 | Halm et al . | |
| 5,123,949 | | 6/1992 | Thiessen . | |
| 5,169,580 | * | 12/1992 | Marcus . | |
| 5,218,740 | * | 6/1993 | Synder et al. . | |
| 5,238,612 | * | 8/1993 | Halm et al. . | |
| 5,286,556 | * | 2/1994 | Tesch . | |
| 5,294,392 | * | 3/1994 | Marcus . | |
| 5,329,868 | * | 7/1994 | Tesch . | |
| 5,338,500 | | 8/1994 | Halm et al. . | |
| 5,344,707 | | 9/1994 | Synder . | |
| 5,458,971 | | 10/1995 | Hernandez et al. . | |
| 5,491,186 | * | 2/1996 | Kean et al. | 524/13 |

(List continued on next page.)

FOREIGN PATENT DOCUMENTS

| | | |
|---|---|---|
| 2 065 7285A | 7/1981 | (GB) . |
| 364703 | 5/1976 | (RU) . |
| WO 89/04886 | 6/1989 | (WO) . |
| WO 96/10665 | 4/1996 | (WO) . |

OTHER PUBLICATIONS

International Search Report for PCT/US00/16131 prepared by EPO, dated Aug. 2, 2000.

*Primary Examiner*—Cheryl Juska
(74) *Attorney, Agent, or Firm*—Pitney, Hardin, Kipp & Szuch LLP

(57) ABSTRACT

A blowable insulation material includes batt shredded into blowable clusters. In the several embodiments, the clusters include water-repellant or lubricant-finished fiber and/or dry fiber and/or binder fiber, and may be a mixture of clusters and a natural material including down, silk, wool, cotton or any other natural material with insulating properties, or any combination thereof, and may also include synthetic open fibers.

7 Claims, 4 Drawing Sheets

U.S. PATENT DOCUMENTS

| | | | | |
|---|---|---|---|---|
| 5,492,580 | | 2/1996 | Frank . | |
| 5,500,295 | * | 3/1996 | Halm et al. . | |
| 5,516,580 | * | 5/1996 | Frennette et al. | 428/288 |
| 5,589,536 | * | 12/1996 | Golino et al. | 524/593 |
| 5,620,541 | | 4/1997 | Herzberg . | |
| 5,624,742 | | 4/1997 | Babbitt et al. . | |
| 5,659,911 | * | 8/1997 | Kirkbride et al. . | |
| 5,683,811 | * | 11/1997 | Hernandez et al. | 428/373 |
| 5,719,228 | * | 2/1998 | Taylor et al. | 524/593 |
| 5,851,665 | | 12/1998 | Marcus . | |
| 6,053,999 | * | 4/2000 | Marcus | 156/73.2 |
| 6,077,883 | * | 6/2000 | Taylor et al. | 523/217 |
| 6,232,249 | * | 5/2001 | Kawada | 442/352 |

* cited by examiner

BLOWABLE INSULATION

CROSS-REFERENCE TO RELATED APPLICATION

This is a continuation-in-part application of U.S. application Ser. No. 09/300,028 filed Apr. 27, 1999 entitled "Blowable Insulation Clusters"

FIELD OF THE INVENTION

The invention relates to down-like insulating clusters and admixtures and to a method for manufacturing the same.

BACKGROUND OF THE INVENTION

There have been many attempts to achieve an insulating material having down-like qualities for use in insulated articles such as clothing, sleeping bags, comforters, and the like. Prior efforts to develop a feasible material have most often yielded materials that are too heavy and dense to be considered down-like and/or are difficult to blow through conventional equipment.

U.S. Pat. No. 5,624,742 to Babbitt et al. describes a blowing insulation that comprises a blend of first and second insulating (glass) fiber materials. One of the groups of fibers is smaller in size for filling the voids between the fibers of the larger group.

U.S. Pat. No. 3,892,919 to Miller describes a filling material using larger cylindrical or spherical formed fiber bodies along with feathery formed bodies which are mixed together, with the latter relied upon to fill the voids.

U.S. Pat. No. 4,167,604 to Aldrich describes an improved thermal insulation material that is a blend of down and synthetic staple fiber formed from hollow polyester filaments which may be treated with silicone and formed into a carded web.

U.S. Pat. No. 4,248,927 to Liebmann describes an insulating material comprising a combination of natural feathers and downs, and synthetic polyesters formed into web.

U.S. Pat. No. 4,468,336 to Smith describes loose fill insulation that is blown into spaces. The insulation material comprises a mixture of loose fill cellulosic insulation mixed with a staple fiber.

U.S. Pat. No. 5,057,168 to Muncrief describes insulation formed by blending binder fibers with insulative fibers. The insulative fibers are selected from the group consisting of synthetic and natural fibers formed into a batt which may be cut into any desired shape.

U.S. Pat. No 5,458,971 to Hernandez et al. describes a fiber blend useful as a fiberfill in garments. The fiberfill blend comprises crimped hollow polyester fiber and crimped binder fibers.

U.S. Pat. No. 4,040,371 to Cooper et al describes a polyester fiber filling material comprising a blend of polyester staple fibers with organic staple fibers.

U.S. Pat. No. 5,492,580 to Frank describes a material formed by blending a mix of first thermoplastic, thermoset, inorganic, or organic fibers with second thermoplastic fibers.

U.S. Pat. No. 4,588,635 to Donovan discloses a superior synthetic down and has particular reference to light-weight thermal insulation systems which can be achieved by the use of fine fibers in low density assemblies and describes a range of fiber mixtures that, when used to fabricate an insulating batt, provides advantageous, down-like qualities such as a high warmth-to-weight ratio, a soft hand, and good compressional recovery. This material approaches, and in some cases might even exceed, the thermal insulating properties of natural down. From a mechanical standpoint however, extremely fine fibers suffer from deficiencies of rigidity and strength that make them difficult to product manipulate and use. Recovery properties of such a synthetic insulator material are enhanced at larger fiber diameter but an increase in the large fiber component will seriously reduce the thermal insulating properties overall. The problems associated with mechanical stability of fine fiber assemblies are excerbated in the wet condition since surface tension forces associated with the presence of capillary water are considerably greater than those due to gravitational forces or other normal-use loading and they have a much more deleterious effect on the structure. Unlike waterfowl down, the disclosed fiber combination described provides excellent resistance to wetting.

U.S. Pat. No. 4,992,327 to Donovan et al. discloses the use of binder fiber components to improve insulator integrity without compromising desired attributes. More specifically, the invention disclosed therein relates to synthetic fiber thermal insulator material in the form of a cohesive fiber structure, which structure comprises an assemblage of: (a) from 70 to 95 weight percent of synthetic polymeric microfibers having a diameter of from 3 to 12 microns; and (b) from 5 to 30 weight percent of synthetic polymeric macrofibers having a diameter of 12 to 50 microns, characterized in that at least some of the fibers are bonded at their contact points, the bonding being such that the density of the resultant structure is within the range 3 to 16 kg/m$^3$, the thermal insulating properties of the bonded assemblage being equal to or not substantially less than the thermal insulating properties of a comparable unbonded assemblage. The reference also describes a down-like cluster form of the preferred fiber blends. The distinct performance advantages of the cluster form over the batt form are also disclosed.

However, prior art clusters often are generally hand-fabricated in a slow, tedious, batch process. Furthermore, the prior art materials are not easily blowable material which can be used with conventional manufacturing equipment. Therefore, there is a need for a blowable material which may be used as a partial or full replacer for down, and which may be manufactured and blown using conventional equipment.

SUMMARY OF THE INVENTION

It is therefore a principal object of the invention overcome the shortcomings of the materials heretofore mentioned.

It is a further object of the invention to provide a blowable material for use as a partial or complete replacement for down or other blowable natural insulation material.

The invention disclosed herein is clusters made from shredded 100% synthetic batt. The batt may be a heatset batt which preferably comprises water-repellant-finished or lubricant-finished fiber and/or dry fiber and/or binder fiber. The batt is then mechanically shredded into small clusters which can be blown through conventional equipment. The somewhat random shape of the clusters allows for better packing, resulting in a more uniform filling. In another embodiment, the clusters are combined with natural materials, including down, silk, wool, cotton and any other natural material having insulating qualities which are suitable for the intended purpose. In yet another embodiment, a composite material of both water-repellant-finished and/or lubricant-finished synthetic fiber and dry synthetic fiber is opened and blended with the clusters along with the aforenoted natural materials. The purpose of all of the embodiments is to provide for a blowable material which has a lofty nature, good compressional properties, improved hand, and superior blendability, uniformity and feel.

DETAILED DESCRIPTION OF THE INVENTION

Figure 1B:
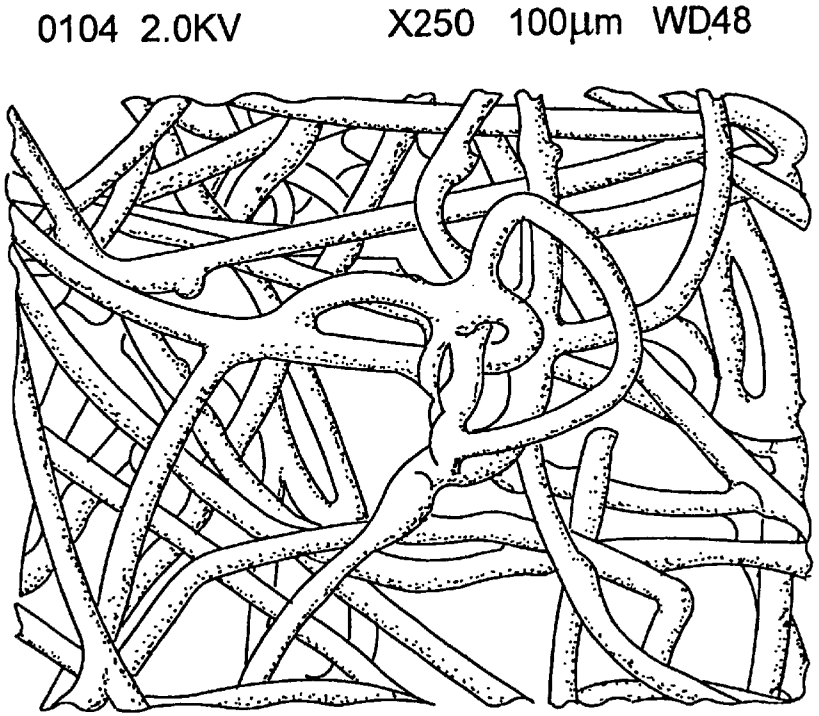
FIG. 1*b* shows a frontal view magnified by SEM of invention shown in FIG. 1*a*.

The inventive material comprises clusters made from a shredded 100% synthetic batt. The batt may or may not be a heatset batt, depending on the composition of the batt. The batt preferably contains water-repellant-finished or lubricant-finished fiber and/or dry fiber and/or binder fiber. The batt is mechanically shredded one or more times into small clusters which are blowable and have desired down-like qualities. It is contemplated that a web (generally a single layer material) and batt (generally a multi-layer material), or portions thereof may be used to make the inventive clusters. Following, by way of example, is a description of methods for manufacturing the clusters.

The clusters may be made with a light-weight card sliver made with a suitable synthetic binder-fiber blend. The fiber-blend is preferably the fiber blend disclosed in U.S. Pat. No. 4,992,327 to Donovan et al, the disclosure of which is incorporated herein by reference.

As aforesaid, this patent discloses an insulation material where microfibers are bonded together to form a support structure for microfibers. Bonding may also be between both macrofibers and some of the microfibers at their various contact points. Preferably, however, bonding is between macrofibers at their contact points. This provides a supporting structure which contributes significantly to the mechanical properties of the insulation material. Other preferred embodiments utilize fiber blends comprising water-repellant-finished or lubricant-finished fiber and/or dry fiber and/or binder fiber. The sliver is first collected at the output side of a card in cans commonly used for this purpose and passes directly through heated tubes that thermally bond the binder-fiber mixture. It important that the bonding step be completed without shrinking and densifying the lofty card sliver. Each sliver end falls through a vertical tube, while centered by guide rings, as heated air blows upward through the tube, bonding the lofty, linear, fiber assembly. Upon exit the heated tube, the sliver is drawn to the entry side of a guillotine-type staple fiber cutter. A clean cut, without the densifying effects of fiber fusion at the cut, is achieved. This method results in a collection of very lofty fiber clusters.

The above method was tested utilizing long, thin slices of ⅞-inch thick, 4 oz/yd$^2$ PRIMALOFT® batt (PRIMALOFT® ONE), rather than card sliver. PRIMALOFT® batt is a cross-lapped, bonded structure, consisting of a fiber blend of the kind described in Donovan et al. as discussed above, and is commercially available. Strips of batt, approximately ⅞-inch wide, were cut along the cross-machine direction (CD), making the fiber orientation generally parallel to the length of the strip and like that of card sliver. The strips taken from PRIMALOFT® batt had been previously bonded and thus had sufficient integrity to be fed easily into the cutter. It is believed that bonding prior to cutting also improved the quality of the cut. The staple cutter used, a laboratory unit manufactured by Ace Machinery Co. of Japan and designated Model No. C-75, was set to cut at ⅞ inch intervals. It cleanly cut the PRIMALOFT® feed stock into a collection of cluster-like cubes (each approximately ⅞×⅞×⅞inch). The density of the cluster collection appeared to be significantly less than 0.5 lb/ft$^3$, making it down-like and a very weight-efficient insulator. A nominal density of 0.5 lb/ft$^3$ and virtually no densification was observed during cutting.

The cluster-collection densities were significantly less than individual-cluster densities. If the inventive clusters were made directly from card sliver rather than batt, the resulting clusters would be somewhat cylindrical in shape, rather than cube-like or rectangular.

Figure 1A:
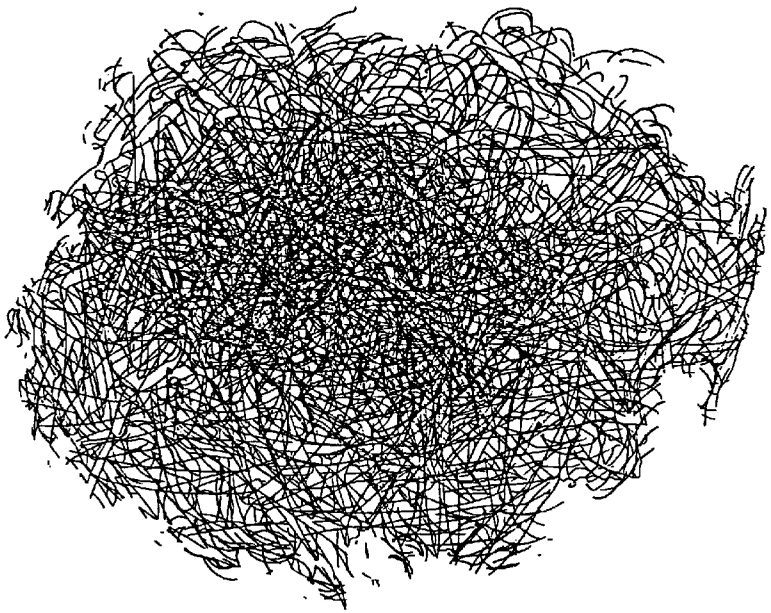
FIG. 1*a* shows a frontal view of a preferred embodiment showing clusters of the invention.

The preferred method uses batt consisting of plied card-laps, although other fibrous forms may be equally suitable. The card-laps or webs, are preferably formed into batt with densities comparable to those of down. The card-laps or webs are prepared from binder fiber and/or dry fiber and/or water-repellant fibers of 0.5–6.0 denier. In this preferred method, the card-laps or webs comprise 40% binder fiber, 30% 1.4 denier dry fiber, and 30% 1.4 denier water repellant fiber. These selected fibers are preferably carded into a 3 oz./sq. yd. assembly by means of a single cylinder metallic card with stationary flats. These cards may be obtained from Hollingsworth Saco Lowell of Greenville, S.C. The output of the card is sent through electric and/or gas fired sources of heat to heatset the binder fiber. The batt is heated for a time and temperature sufficient to cause the fiber to bond. In this case the temperatures used were between 300–400° F. The now heatset batt is then shredded, preferably two times in a Rando Opener Blender (made by the Rando Machine Company of Macedon, N.Y.) to form the inventive clusters. FIGS. 1*a* and 1*b* are frontal views the clusters, twice shredded which shows the random nature of the fibers bonded at various contract points which make up the structure of the cluster.

Other modifications may include:

- Increasing staple length up to the cardable limit to improve integrity and durability of the clusters;
- Changing binder fiber content to "fine tune" shreddability, cuttability, cohesiveness, and the performance characteristics of the clusters;
- Varying the size, shape and aspect ratios of the clusters;
- Using ultrasonic bonding means if suitable for the purpose;
- Shredding the clusters more than once;
- Using batt that is not heatset; and
- Shredding only portions of batt or web.

It has been observed that the twice-shredded clusters are smoother and more easily blendable than clusters which are shredded only once. Further, it is possible to take strips or sliver of heatset batt which may have been slitted, and then take these portions through a standard shredding process to form clusters.

Several modifications of the examples given above will be possible, and may be desirable, without departing from the scope of the invention.

Figure 2B:
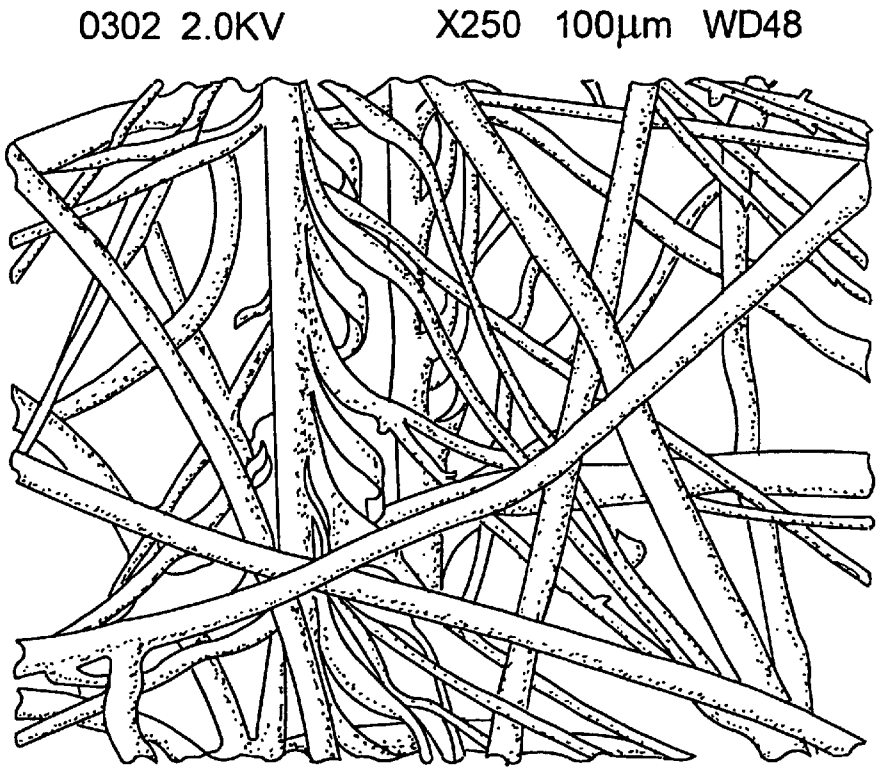
FIG. 2*b* shows a frontal view, magnified by SEM, the invention shown in FIG. 2*a*.
Figure 2A:
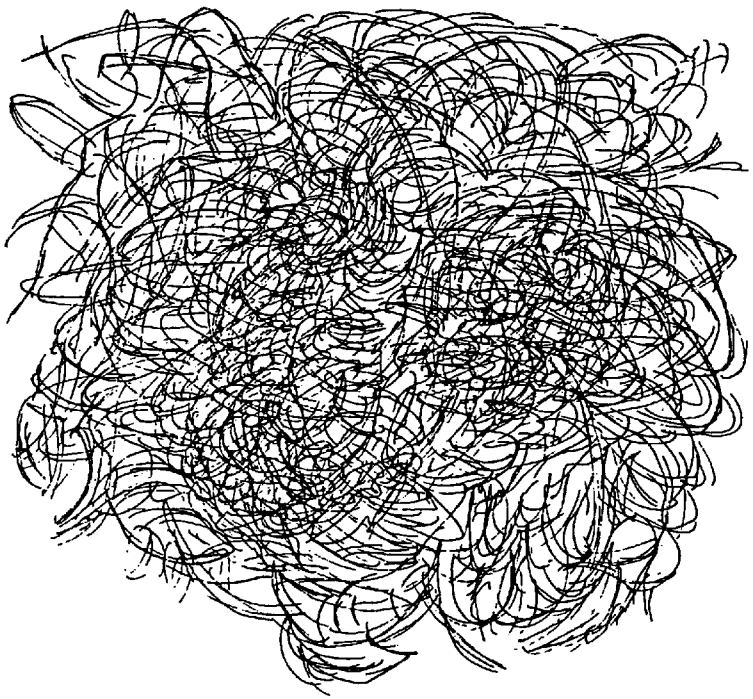
FIG. 2*a* shows a frontal view of a second preferred embodiment showing clusters and a natural material i.e down.

FIGS. 2*a* and 2*b* show another embodiment where the clusters are blended with a natural material, i.e., down. These alternate embodiments were evaluated for loft and compressional behavior and were tested as fill for channels in fabric. The blended materials were found to be superior to the individual components that comprise it. It should be understood that the invention contemplates the use of other natural materials such as silk, wool, cotton and other natural insulation material suitable for the intended purpose, or a combination thereof, in an admixture with clusters. Of course, to the extent necessary, such material may be processed to provide for blowability of the mixture. Also, the invention further contemplates another embodiment that comprises the admixture of clusters, natural material and synthetic materials including open fibers. The open fibers used in the mixture may be any mixture of 0.5 to 6.0 denier fiber, water-repellant or lubricant-finished.

Test 1

Properties of clusters

Twenty-five (25) lbs. of twice-shredded batt cluster comprising 30% water-repellant or lubricant-finished fiber 30% dry fiber, and 40% binder fiber was emptied into a mixing tank of a blowing station. The shredded batt clusters alone opened up quite readily once the beaters the tank were turned on and passed though the metering blowing system without any problems.

Test 2

Properties of Clusters Mixed with a Natural Material, i.e., down

Subsequently, twenty-five pounds of down were added to the tank of Test 1. Within five minutes of blending, the product appeared quite uniform and very down like. The product blew extremely well. The product was put into a vest for evaluation of hand. The product spread well. The mixture was also easier to work with than down alone.

Test 3

Properties of a Natural Material, i.e., down with clusters added

Twenty-five pounds of down were emptied into a mixing tank of a blowing station. Subsequently, twenty-five pounds of the shredded batt were added. The components appeared to blend well, although it took longer to occur than in the method of Test 2. Furthermore, the resulting product had a slightly less uniform look to it. The product blew extremely well. The product was put into a vest for evaluation of hand. The spreadability of the product was less than that of the product of Test 2. However, the mixture was still easier to work with than down alone.

The processes were repeated several times to ensure that the process was reproducible. A 50-lb. batch of the product of Test 2 was made and 12 vests were filled. The blending was as effortless and uniform as in the previous trial, and the product blew just as well in the down. However, instead of a 50/50 ratio of clusters and down, the ratio of clusters/down was changed to 65/35. The product neither blew as well as the 50/50 ratio nor was it as uniform.

Test 4

The process of Test 2 was repeated. However, instead of a 50/50 ratio of clusters and down, the ratio of clusters/down was changed to 75/25. The product neither blew as well as the 50/50 ratio nor was it as uniform.

In summary, the blends using higher percentages of clusters blended with a natural material, i.e., down, had less down-like feel than the 50/50 blend. These blends were also difficult to meter in precise amounts. Blow nozzle sizing may compensate for this. In some cases, hand blending may also be incorporated to enhance the properties of the mixtures.

The ability to resist water absorption is an area where the clusters are superior to down. Tests were conducted to measure the loft, water gain and density of synthetic blends and down/synthetic insulation types and down when dry and after various soaking times in water.

Test 5

In end use, insulation materials are used in garments or sleeping bags. In order to represent a realistic wetting situation, the test materials were placed in fabric pillowcases prior to soaking. These pillowcases were 8"×9" and made of 3 oz/sq.yd. ripstop nylon sewn on three edges. The fourth edge was pinned with safety pins.

The materials tested were the natural material, i.e., down, 50/50 down/shredded batt clusters, shredded batt clusters alone, shredded batt clusters with antistatic treatment. Twelve (12) grams of insulation material were placed in each pillowcase; three replicates were filled of each material type. The initial loft and weight of each sample was measured and recorded.

Figure 3:
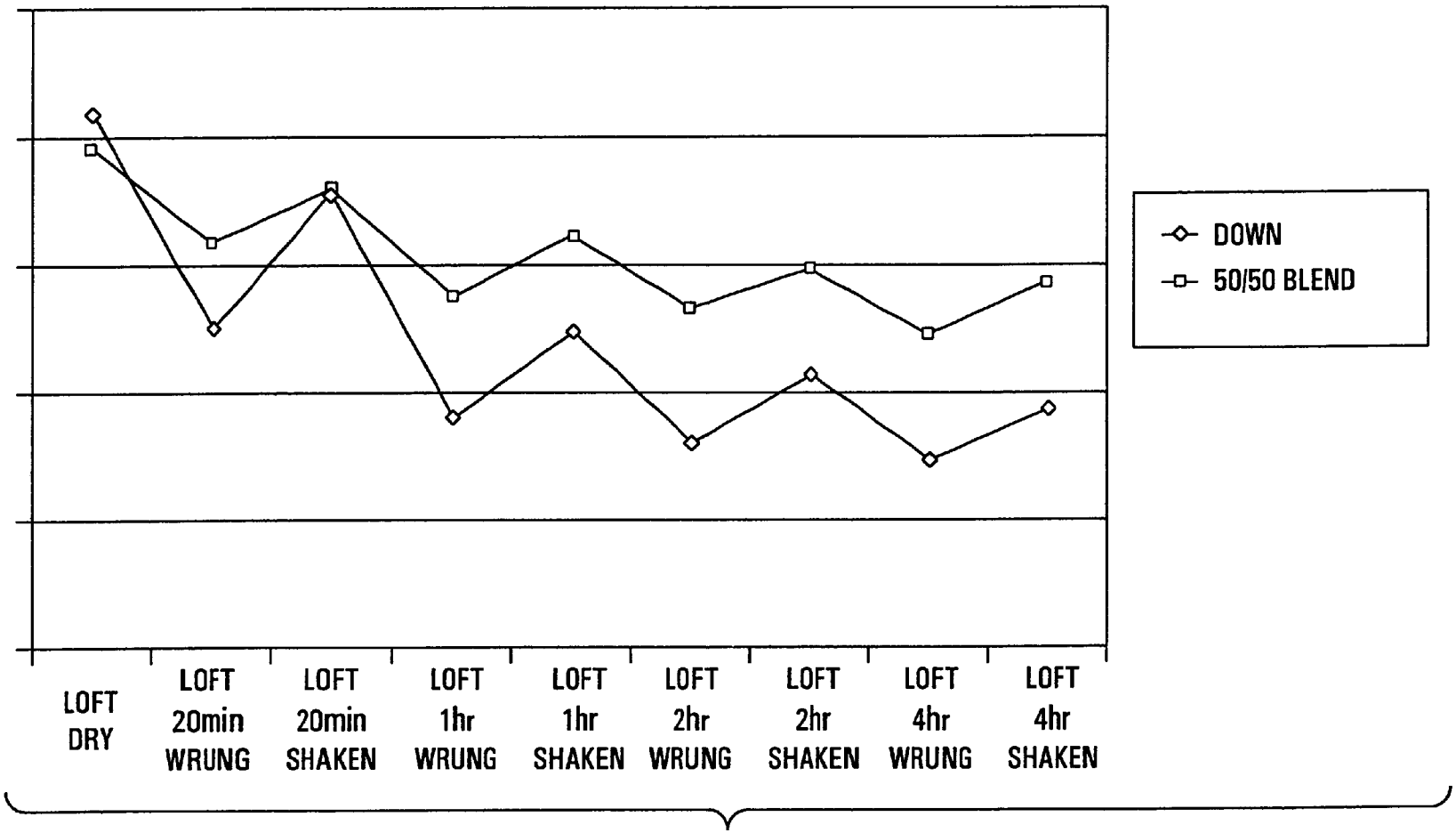
FIG. 3 shows a comparison graph of loft after soaking materials.
Figure 4:
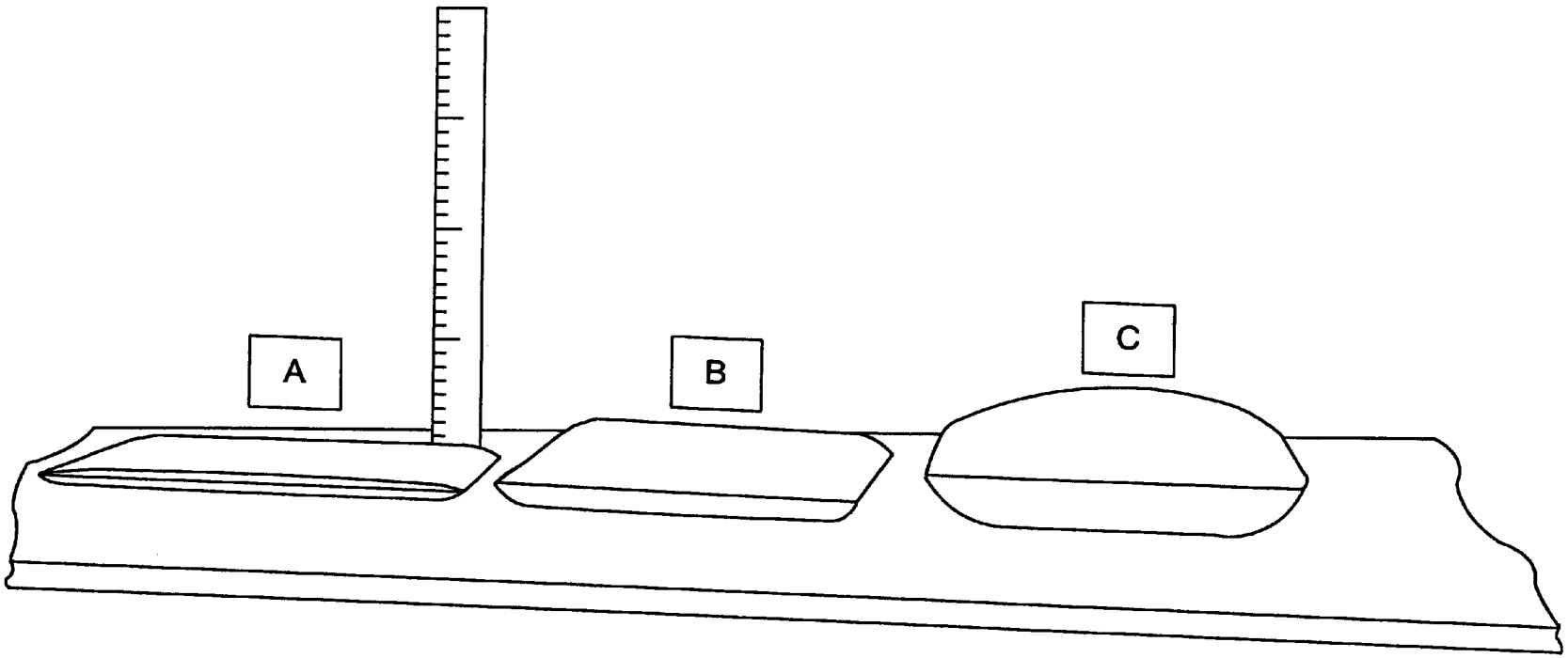
FIG. 4 shows a comparison photograph of loft after soaking materials.

Each sample was first submerged in 70° F. water for 10 seconds, then allowed to remain floating in the water for 20 minutes. At that time, each sample was run through an industrial wringer once and loft was measured. Each sample was then shaken vigorously for *10* seconds and loft was again recorded. The samples were then submerged again for 10 seconds, and the process repeated so that measurements could be made after 1, 2 and 4 hours of total soaking, exposure. FIG. 3 shows a graph comparing the effect on loft by soaking exposure. FIG. 4 is a picture showing the differences in loft after soaking exposure where (A) is down after four hours of soaking, wringing and shaking; (B) is 50/50 down/shredded batt after four hours of soaking, wringing and shaking; and (C) is dry down.

When the cluster/down mixture was washed, the mixture became loftier. Normally, under wet performance conditions, down is not as lofty as it is when dry. The down flattens out and, as a result, gets thinner. The clusters (alone and in mixture with down) show superior water resistance and are enhanced by washing, and do not clump as is typical in material filled with down alone.

It is noted that the use of clusters (and opened fibers) may result in some static electricity in the product which may be addressed with fabric softening sheets and/or static-removal spray. It is sometimes desirable to treat the batt (before shredding) with a static-removal treatment.

Thus, by the present invention, its advantages will be realized and, although preferred embodiments have been disclosed and described in detail herein, its scope should not be limited thereby. Rather its scope should be determined by that of the appended claims.

What is claimed is:

1. A blowable insulation material comprising one or more of the materials taken from the group consisting of bonded batt, bonded web, a portion of bonded batt, and a portion of bonded web shredded one or more times into random shaped blowable clusters which are comprised of random fibers bonded together at a plurality of contact points between fibers in an admixture with a blowable natural insulation material.

2. The blowable insulation material of claim 1 wherein the natural material comprises one or more taken from the group consisting of down, wool, silk and cotton.

3. The blowable insulation material of claim 1 wherein the clusters comprise no more than 50% of the admixture.

4. The blowable insulation material of claim 1 wherein the clusters comprise no more than 40 to 75% by weight of the admixture.

5. The blowable insulation material of claim 1 further comprising one or more of the materials taken from the group consisting of opened water-repellent synthetic fiber, lubricant-finished synthetic fiber and dry synthetic fiber.

6. The blowable insulation material of claim 5 wherein the dry fiber is dry polyester and the water-repellant or lubricant-finished fiber is siliconized polyester.

7. The blowable insulation material of claim 5 wherein the natural material comprise one or more taken from the group consisting of down, wool, silk and cotton.

* * * * *